United States Patent [19]

Brown et al.

[11] Patent Number: 4,768,892

[45] Date of Patent: Sep. 6, 1988

[54] ELECTROMAGNETIC HAMMER ACTUATOR FOR IMPACT PRINTER

[75] Inventors: Douglas S. Brown, Matthews; William A. Patterson, Charlotte; William D. Thorne, Raleigh, all of N.C.

[73] Assignee: International Business Machines Corporation, Armonk, N.Y.

[21] Appl. No.: 878,939

[22] Filed: Jun. 26, 1986

Related U.S. Application Data

[63] Continuation-in-part of Ser. No. 760,267, Jul. 29, 1985, abandoned.

[51] Int. Cl.[4] ..... B41J 9/38

[52] U.S. Cl. ..... 400/157.2; 101/93.48; 335/281; 335/262

[58] Field of Search ..... 101/93.48, 93.13, 93.04; 400/157.2, 146; 335/279, 261, 281, 262, 267, 112, 124

[56] References Cited

U.S. PATENT DOCUMENTS

| | | | |
|---|---|---|---|
| 2,743,398 | 4/1956 | Thompson | 335/267 |
| 3,144,226 | 8/1964 | Noble | 335/267 |
| 3,386,377 | 6/1968 | Dalton | 101/93.48 |
| 3,513,773 | 5/1970 | Ponzano | 400/157.2 |
| 3,821,672 | 6/1974 | Sturm | 335/267 |
| 3,971,311 | 7/1976 | Deproux | 101/93.04 |
| 4,233,585 | 11/1980 | Sugimoto et al. | 335/262 |
| 4,242,955 | 1/1981 | Wasserman | 400/157.2 |
| 4,425,845 | 1/1984 | Bohg et al. | 101/93.48 |
| 4,480,935 | 11/1984 | Kurihara | 400/146 |
| 4,527,139 | 7/1985 | Bohg et al. | 335/259 |

FOREIGN PATENT DOCUMENTS

| | | | |
|---|---|---|---|
| 1135317 | 11/1982 | Canada | 101/93.48 |
| 2063830 | 7/1971 | Fed. Rep. of Germany | 400/93.48 |
| 2446432 | 4/1975 | Fed. Rep. of Germany | 101/93.13 |
| 40026 | 3/1977 | Japan | 400/157.2 |
| 74182 | 5/1982 | Japan | 400/157.2 |
| 1355524 | 6/1974 | United Kingdom | 101/93.48 |

OTHER PUBLICATIONS

Patterson et al, "Horizontal Sliding . . . Mechanism", IBM Tech. Disclosure Bulletin, vol. 25, No. 11B, pp. 6284–6285, 4–83.

Bohg et al, "Cavity Armature . . . " IBM Technical Disclosure Bulletin, vol. 25, No. 11B, p. 6184, 4–83.

Meier, "Actuators for . . . Printer", IBM Technical Disclosure Bulletin, vol. 21, No. 12, pp. 4813–4816, 5–79.

*Primary Examiner*—William Pieprz

*Attorney, Agent, or Firm*—E. Ronald Coffman; R. M. Chiaviello, Jr.; Mitchell S. Bigel

[57] ABSTRACT

The present invention relates to an assembly of electromagnetic actuators for the hammers of an impact printer arranged side by side and extending along a line. Each actuator comprises a first stator part formed with at least one pole piece, a second stator part formed with at least one pole piece and positioned relative to the first stator part so that the pole pieces are spaced apart so as to form a gap therebetween. A single coil is associated with one of the stator parts. Each actuator also includes an armature member formed with a body of non-magnetizable material, at least one armature element of magnetizable material and a hammer head. The armature member is supported between the stator parts so that the armature element is located adjacent to the gap. Energization of the coil causes the generation of a flux which passes across the gap and through the armature element tending to move the armature element into the gap and to cause the hammer head to move into a print position.

According to the invention the components of adjacent actuators are complementary in shape so that projecting components of each actuator engage in recessed components of the adjacent actuators whereby the overall length of the assembly along the line is less than the sum of the overall widths of the individual actuators.

6 Claims, 12 Drawing Sheets

ELECTROMAGNETIC HAMMER ACTUATOR FOR IMPACT PRINTER

CROSS REFERENCE TO RELATED PATENTS

This is a continuation-in-part of our co-pending patent application Ser. No. 760,267 filed July 29, 1985, now abandoned.

FIELD OF INVENTION

The present invention relates to impact printers of the type including a plurality of hammers which are actuated selectively in order to perform printing operations on a print medium, for example a sheet of paper. A printer of this type includes an actuator for each hammer and the present invention is particularly related to electromagnetic print hammer actuators.

BACKGROUND OF THE INVENTION

In one known type of printer, adapted to print on a print medium as it passes over a platen using a plurality of print elements operated selectively by hammers, the print elements are mounted on flexible fingers forming part of a metal band which is in the form of a continuous loop, one print element being mounted on each flexible finger. The print elements extend in a straight line along the band parallel to the longitudinal center line of the band. A bank of hammers extends along the platen and is spaced from the platen so as to define a print region between the hammer bank and the platen. The print medium, such as a continuous web of paper, extends through the print region over the platen so that the hammer bank extends across the width of the print medium. The metal band on which the print elements are mounted also extends through the print region along the platen and across the width of the print medium and is located between the hammer bank and the print medium. An ink ribbon also is located in the print region between the metal band and the print medium.

The metal band is driven continuously past the platen and the hammer bank and across the print medium by a suitable drive system. Operation of any one of the hammers of the bank causes that hammer to move towards the metal band and to strike one of the print elements so as to move that print element on its flexible finger towards the ink ribbon and the print medium. The print element abuts against the ink ribbon, moves the ink ribbon into contact with the print medium and presses the ink ribbon and the print medium against the platen causing the printing of a mark on the print medium in the shape of the print element.

According to one particular printer of the above kind and illustrated by way of example in U.S. Pat. No. 4,428,284, each of the print elements is shaped like a dot and operation of each hammer causes the printing of a dot on the print medium. As the metal band moves continuously across the print medium, operation of selected hammers will result in the printing of a row of dots in positions on the print medium corresponding to the positions of the hammers which are operated. Each hammer is formed with a head having a width in the direction of movement of the band which is greater than the width of a single print element. It is therefore possible for each hammer to print a dot in any position on the print medium which is covered by the hammer by varying the timing of the operation of the hammer relative to the movement of the band. As a result, the dots in the row printed can occupy many selected positions on the print medium. There is only a small gap between each pair of adjacent hammer heads and the hammers can therefore print dots at all required positions along the row being printed.

After one row of dots has been printed the print medium can be moved through a small increment transversely to the length of the platen and the operation can be repeated resulting in the printing of a second row of dots spaced from the first row of dots. By repeating these operations rows of dots can be printed as required.

A character can be printed on the medium by printing dots in selected positions in a matrix, for example a matrix of five columns and seven rows. By printing dots in selected positions in rows as described above and selectively moving the print medium, characters can be printed in selected positions on the medium.

In the printer described above the hammers are mounted together to form a hammer bank which extends along the platen. Each hammer is formed with a head and is associated with a respective actuator which has a finite width. It is desirable for the heads of adjacent hammers to be spaced apart by only a small distance so as to be able to print dots substantially at all positions along a row on the print medium. With such an arrangement each hammer head will cover a plurality of positions in which dots are required to be printed and therefore each hammer will have to be operated a plurality of times in printing a row of dots. In order to reduce the number of times that each hammer will have to be operated in printing a row of dots, the width of each hammer must be reduced. This requires that the width of each hammer and actuator assembly must be reduced.

Various types of printer hammer actuator are known. One particular type with which the present invention is concerned is described by way of example in Canadian Pat. No. 1,135,317. The printer hammer actuator described is an electromagnetic actuator which includes a stator in two halves, each provided with a coil, and a moving armature member which is located between the two stator halves. The armature member is formed from a non-magnetizable material, for example a synthetic plastic material, and is flat with a rectangular cross section. The armature member is provided with a plurality of armature elements of magnetizable material. The armature elements are spaced apart along the length of the armature member. The armature member is provided with longitudinally extending ribs to add to its strength and to guide it during operation. A hammer head is formed at one end of the armature member.

The stator of the actuator is formed in two halves with pole pieces extending towards each other in pairs and spaced apart so as to form a set of gaps in which the armature member is located. When the armature member is in the rest position each of the armature elements in the armature member is slightly spaced from a respective one of the pairs of pole pieces of the stator. When the coils of the stator are energized, a flux is generated which flows between the pairs of pole pieces and through the armature elements. As a result each armature element is attracted to the adjacent pair of pole pieces and a longitudinal force is exerted on the armature member. The armature member is retained in its rest position by a spring. The longitudinal force causes the armature member to move against the action of this spring and allows the head on the armature to perform a printing operation.

Canadian Pat. No. 1,135,317 also describes assembling a plurality of actuators of this kind side by side to form a hammer bank. The armature elements on the armature members of adjacent actuators are located at opposite ends of the armature members. As a result the stator coils of adjacent actuators are also located at opposite ends of the actuators. With this arrangement the stator coils are interleaved and thereby reduce the overall length of the hammer bank.

U.S. Pat. No. 4,371,857 describes a similar type of hammer actuator in which the armature member is circular in cross section and the stator is formed in two halves. In one arrangement the stator is illustrated as having a coil on only one half.

IBM Technical Disclosure Bulletin Volume 25, No. 11B, April 1983 at page 6184 also describes a similar type of actuator in which the stator is formed in two halves with a coil on only one half.

IBM Technical Disclosure Bulletin Volume 25, No. 11B, April 1983 at pages 6284, 6285 describes a bank of print hammer actuators of the above type in which the actuators are arranged side by side. The armature elements and stator coils of adjacent actuators are located at opposite ends of the armature members so that the stator coils are interleaved and thereby reduce the overall length of the hammer bank.

U.S. Pat. Nos. 4,351,235 and 4,082,035 describe printers which are formed with banks of hammer actuators. Each hammer actuator includes an armature member of magnetizable material which cooperates with a stator provided with a coil. Each armature member is formed with a hammer head at one end and all the hammer heads of the actuators in the bank extend along a line. The actuators are located on both sides of this line with adjacent actuators on opposite sides. With this arrangement the stator coils are interleaved and thereby reduce the overall length of the hammer bank.

The object of the present invention is to provide an improved assembly of electromagnetic printer hammer actuators.

SUMMARY OF THE INVENTION

The present invention relates to an assembly of electromagnetic actuators for the hammers of an impact printer arranged side by side and extending along a line. Each actuator comprises a first stator part formed with at least one pole piece, a second stator part formed with at least one pole piece and positioned relative to the first stator part so that the pole pieces are spaced apart so as to form a gap therebetween, and a single coil associated with one of the stator parts. Each actuator also includes an armature member formed with a body of non-magnetizable material, at least one armature element of magnetizable material and a hammer head. The armature member is supported between the stator parts so that the armature element is located adjacent to the gap between the pole pieces. Energization of the coil causes the generation of a flux which passes across the gap and through the armature element tending to move the armature element into the gap and to cause the hammer head to move into a print position.

According to the invention the components of adjacent actuators are complementary in shape so that projecting components of each actuator engage in recessed components of the adjacent actuators whereby the overall length of the assembly along the line is less than the sum of the overall widths of the individual actuators.

According to one embodiment of the invention, in each actuator the coil is associated with the first stator part, and the second stator part includes a component having a width less than the width of the coil. In adjacent actuators the coil is located at the top of one actuator and at the bottom of the other actuator so that the coil of each actuator engages in the component of the adjacent actuator having a width less than the width of the coil.

According to another embodiment of the invention the body of each armature member includes a relatively wide portion in which is located the armature element and a relatively narrow portion. In adjacent actuators the relatively wide portion of the armature member is located near one end of the body in one actuator and near the opposite end of the body in the other actuator so that the relatively wide portion of the armature member of each actuator engages in the relatively narrow portion of the armature member of the adjacent actuator.

BRIEF DESCRIPTION OF THE DRAWINGS

These and other objects, features and advantages of the invention will be more fully understood by those working in the art by reading and understanding the following description of a preferred embodiment of the invention, wherein reference is made to the accompanying drawings of which.

DETAILED DESCRIPTION OF THE INVENTION

Figure 1:
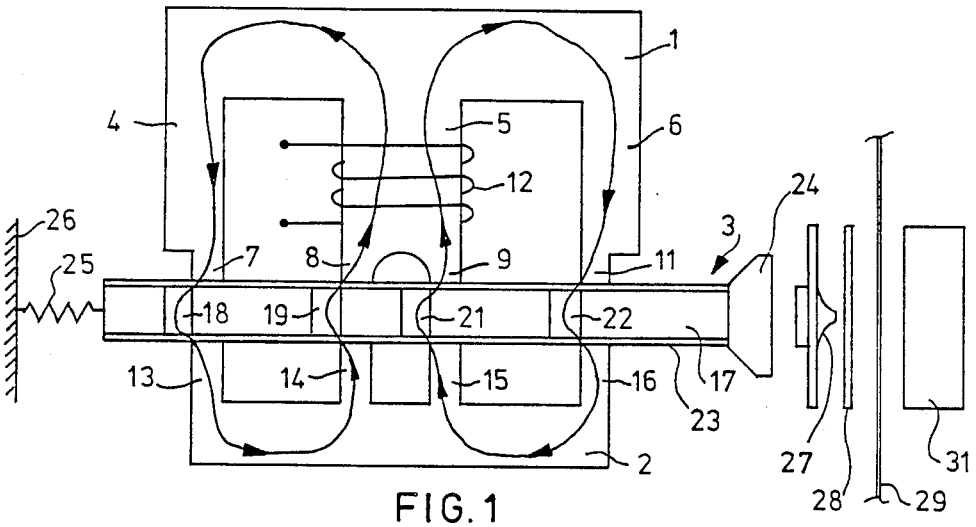
FIG. 1 is a diagrammatic side view of a hammer actuator including a stator and an armature member.
Figure 2:
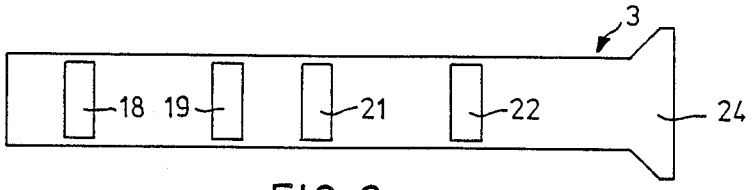
FIG. 2 is a plan view of the armature member used in the actuator illustrated in FIG. 1.
Figure 3:
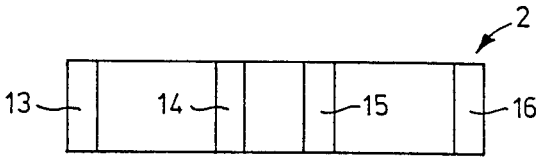
FIG. 3 is a plan view of the lower part of the stator used in the actuator illustrated in FIG. 1.
Figure 4:
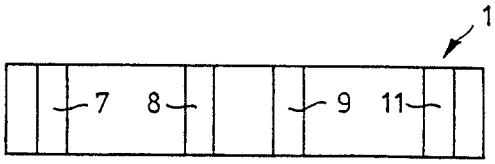
FIG. 4 is a view from underneath of the upper part of the stator used in the actuator illustrated in FIG. 1.
Figure 5:
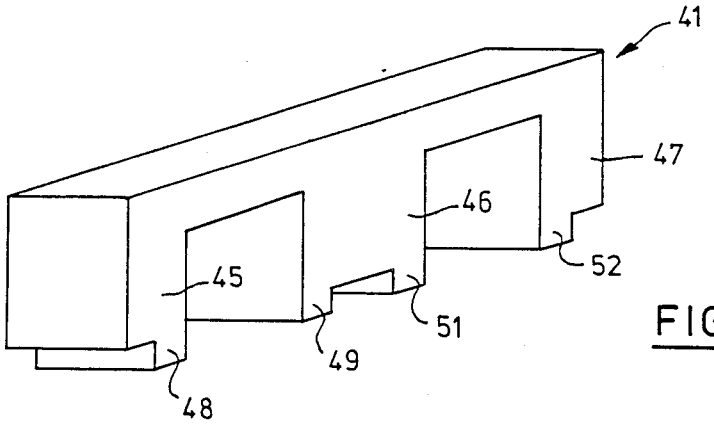
FIG. 5 is a perspective view of one part of the stator used in an actuator which is a practical embodiment of the actuator illustrated in FIGS. 1, 2, 3 and 4.
Figure 6:
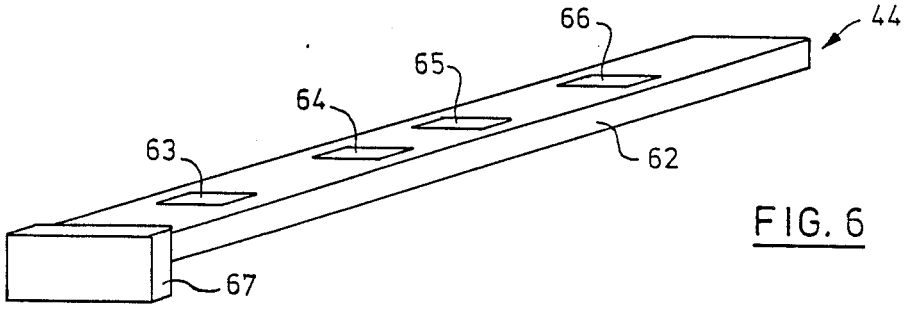
FIG. 6 is a perspective view of an armature member used with the stator part illustrated in FIG. 5.
Figure 7:
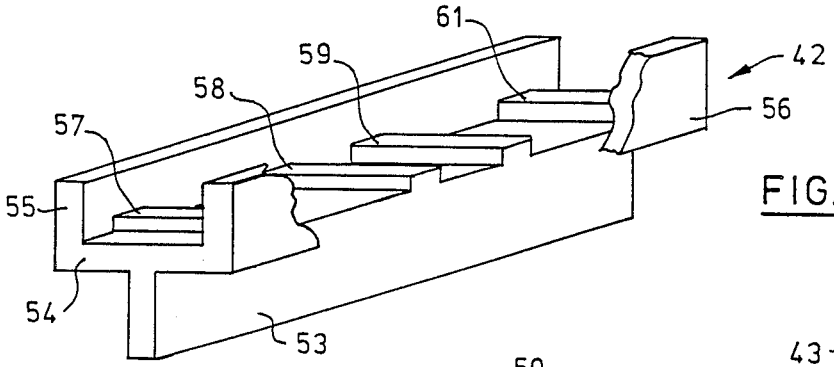
FIG. 7 is a perspective view, partly cut away, of the other part of a stator used with the stator part illustrated in FIG. 5.
Figure 8:
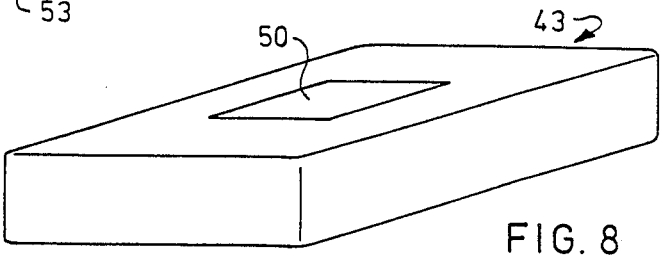
FIG. 8 is a perspective view of a stator coil used with the stator part illustrated in FIG. 5.

FIGS. 1, 2, 3 and 4 illustrate diagrammatically an electromagnetic printer hammer actuator with which the present invention is concerned. The actuator comprises an upper stator part 1, a lower stator part 2 and an armature member 3. The upper stator part 1 is generally E-shaped and is formed with three legs 4, 5 and 6 which are shaped at their ends to form four pole pieces 7, 8, 9 and 11. Around the central leg 5 is wound a coil 12 which is adapted to be supplied with a suitable voltage through a switch (not illustrated). The lower stator part 2 is formed on its upper surface with four legs 13, 14, 15 and 16 also forming pole pieces. The pole pieces 13, 14, 15 and 16 are positioned respectively under the pole pieces 7, 8, 9 and 11 of the upper stator part 1 so as to form four pole pairs with gaps between the poles of each pair. As illustrated in FIGS. 3 and 4 the pole pieces 7, 8, 9 and 11 and 13, 14, 15 and 16 extend across the full width of the stator parts 1 and 2.

The armature member 3 has a rectangular cross section body portion 17 of non-magnetizable material, for example a synthetic plastic material, and is formed with four armature elements 18, 19, 21 and 22 of soft iron or another magnetizable material and having a rectangular cross section. As illustrated in FIG. 2 the armature elements 18, 19, 21 and 22 extend across the armature member 3 but do not reach quite to the edges of the armature member. The armature elements 18, 19, 21 and 22 are spaced apart by distances equal to the distances apart of the pole pieces 7, 8, 9 and 11. Therefore, if the armature member 3 is located between the stator parts 1 and 2, each armature element can be located adjacent to a respective one of the pole pairs. The outer surfaces of the armature member 3 are coated with a layer 23 of a low friction material, such as the polytetrafluoroethylene material known as Teflon (Registered Trade Mark).

A hammer head 24 is formed on one end of the armature member 3 and at the other end a spring 25 extends between the armature member 3 and a fixed member 26. The head 24 is arranged to cooperate with a print element 27, an ink ribbon 28, a print medium 29 and a platen 31 in order to perform printing operations on the print medium 29.

In order to perform printing operations using the hammer head 24 and the actuator described, the components are assembled so that the armature member 3 is located between the stator parts 1 and 2 with the armature elements 18, 19, 21 and 22 positioned just to the left of the respective pole pairs 7 and 13, 8 and 14, 9 and 15, 11 and 16, as viewed in FIG. 1. With the armature member 3 in this position, the head 24 is spaced from the print element 27. If the coil 12 is energized a magnetic flux will be produced in the assembly as illustrated by the arrows in FIG. 1. This flux will be concentrated at the pole pieces 7, 8, 9 and 11 and 13, 14, 15 and 16 and, in passing between the pole pairs, it will be deflected to pass through the armature elements 18, 19, 21 and 22. The flux will tend to cause each armature element to move into a position in which it is directly between the pole faces of the adjacent pair of poles.

As a result, a longitudinal force will be exerted on the armature member 3 tending to move it to the right, as viewed in FIG. 1, against the action of the spring 25. The armature member 3 will move to the right and the head 24 will strike the print element 27. The print element 27 will move into contact with the ink ribbon 28 and move the ink ribbon into contact with the print medium 29. The ink ribbon 28 and the print medium 29 will be pressed against the platen 31 causing a printing operation to be performed in which a mark in the shape of the print element 27 will be printed on the print medium 29. This printing operation is fully described in U.S. Pat. No. 4,428,284 and will not be described in greater detail here since it does not form part of the present invention.

The forces exerted on the armature member 3 by the flux generated by the coil 12 are partly longitudinal forces and partly transverse forces. The longitudinal forces are used to move the armature member 3 longitudinally in order to perform the printing operation described above. The transverse forces will tend to move the armature member into close contact with the stator parts 1 and 2. This action would tend to exert frictional forces on the armature member 3 which would interfere with the printing operation. By coating the armature member 3 with the layer 23 of low friction material, these frictional forces are appreciably reduced. The layer 23 covers all the outer surfaces of the armature elements 18, 19, 21 and 22 and therefore there is no metal to metal contact between the armature member 3 and the stator parts 1 and 2.

In a practical embodiment of an actuator as described above the coating layer 23 has a thickness of 0.13 mm (0.0005 in) and the length of each of the legs 13, 14, 15 and 16 is 0.4 mm (0.016 in).

FIGS. 5, 6, 7, 8 and 9 illustrate an actuator which is a practical embodiment of the actuator illustrated in FIGS. 1, 2, 3 and 4. The actuator comprises an upper stator part 41, a lower stator part 42, a stator coil 43 and an armature member 44. The upper stator part 41 is generally E-shaped with three legs 45, 46 and 47 terminating in four pole pieces 48, 49, 51 and 52. The coil 43 is formed around a central hole 50 and is shaped so as to fit round the central leg 46 of the upper stator part 41. The lower stator part 42 is generally Y-shaped in cross section with a lower leg portion 53, a central portion 54 extending at right angles to the leg portion 53 and two upstanding side portions 55 and 56. The central portion 54 is substantially planer, that is, having an overall thickness narrower than the thickness of coil 43, and is formed with four upstanding legs forming pole pieces 57, 58, 59 and 61 which extend across the width of the central portion 54 between the side portions 55, 56. The central portion 54 and the pole pieces 57, 58, 59 and 61 of lower stator part 42 are constructed of a soft magnetizable material such as silicon iron whereas the lower leg portion 53 and the side portions 55 and 56 are constructed of a non-magnetizable material such as a synthetic plastic. The pole pieces 57, 58, 59 and 61 are spaced apart by the same distances as the pole pieces 48, 49, 51 and 52. The armature member 44 has a rectangular cross section body portion 62 of a non-magnetizable material, for example a synthetic plastic material, and four armature elements 63, 64, 65 and 66 of magnetizable material within the body portion 62. The armature elements 63, 64, 65 and 66 are spaced apart by the same distances as the pole pieces 57, 58, 59 and 61. The body portion 62 of the armature member is coated with a layer of low friction material, for example the polytetrafluoroethylene material known as Teflon (Registered Trade Mark). For clarity of FIG. 6 this layer is not illustrated. At one end of the armature member 44 is formed a hammer head 67.

Figure 9:
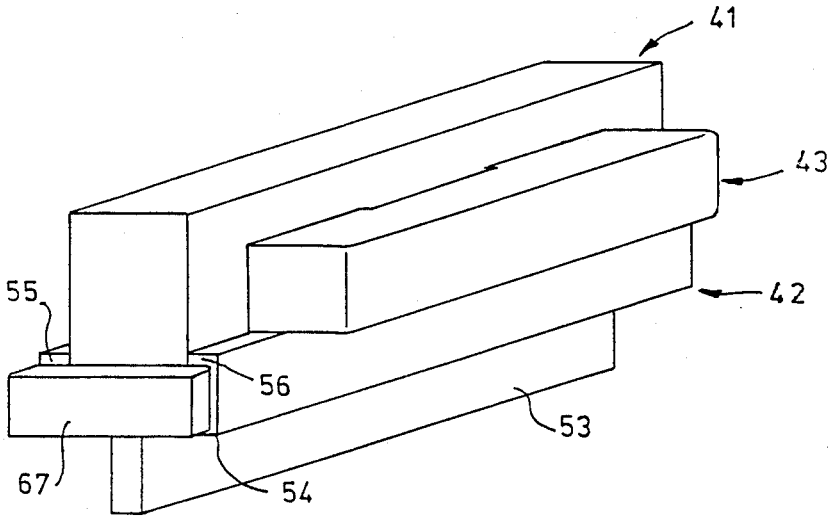
FIG. 9 is a perspective view of an actuator assembled from the components illustrated in FIGS. 5, 6, 7 and 8.

FIG. 9 illustrates the actuator fully assembled. The armature member 44 is located on the central portion 54 of the lower stator part 42. The distance between the inner surfaces of the side portions 55 and 56 is slightly greater than the width of the armature member 44. The distance between the faces of each pole pair 48 and 57, 49 and 58, 51 and 59 and 52 and 61 is slightly greater than the thickness of the armature member 44 in the vertical direction. As a result, the armature member 44 is constrained to move longitudinally with the side portions 55 and 56 and the pole faces acting as guides. The overall width of the coil 43 is greater than the distance between the outer surfaces of the side portions 55 and 56 so that the coil projects beyond these side portions. The movement of the armature member 44 is controlled as described with reference to FIGS. 1, 2, 3 and 4.

Figure 10:
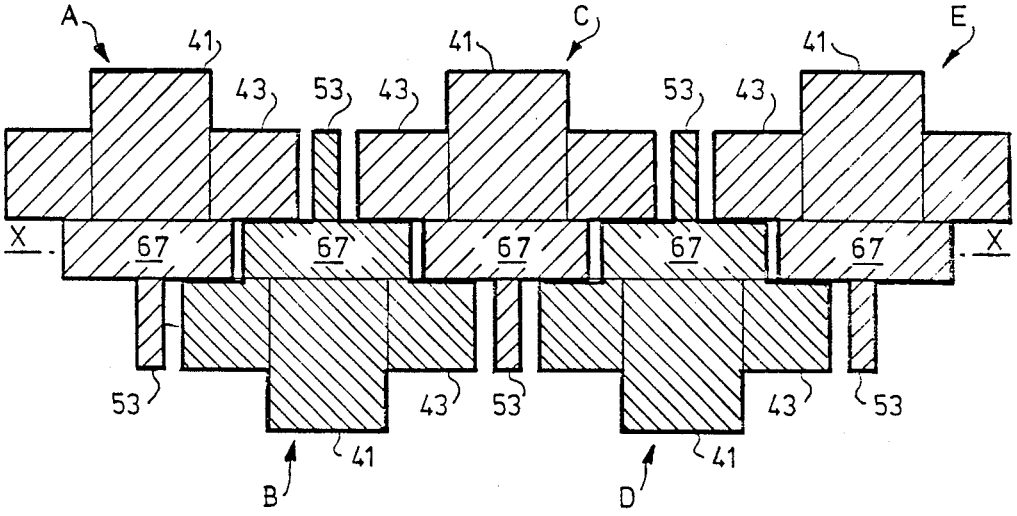
FIG. 10 is an end view of a plurality of actuators as illustrated in FIG. 9 assembled to form a bank of hammers embodying the invention.
Figure 11:
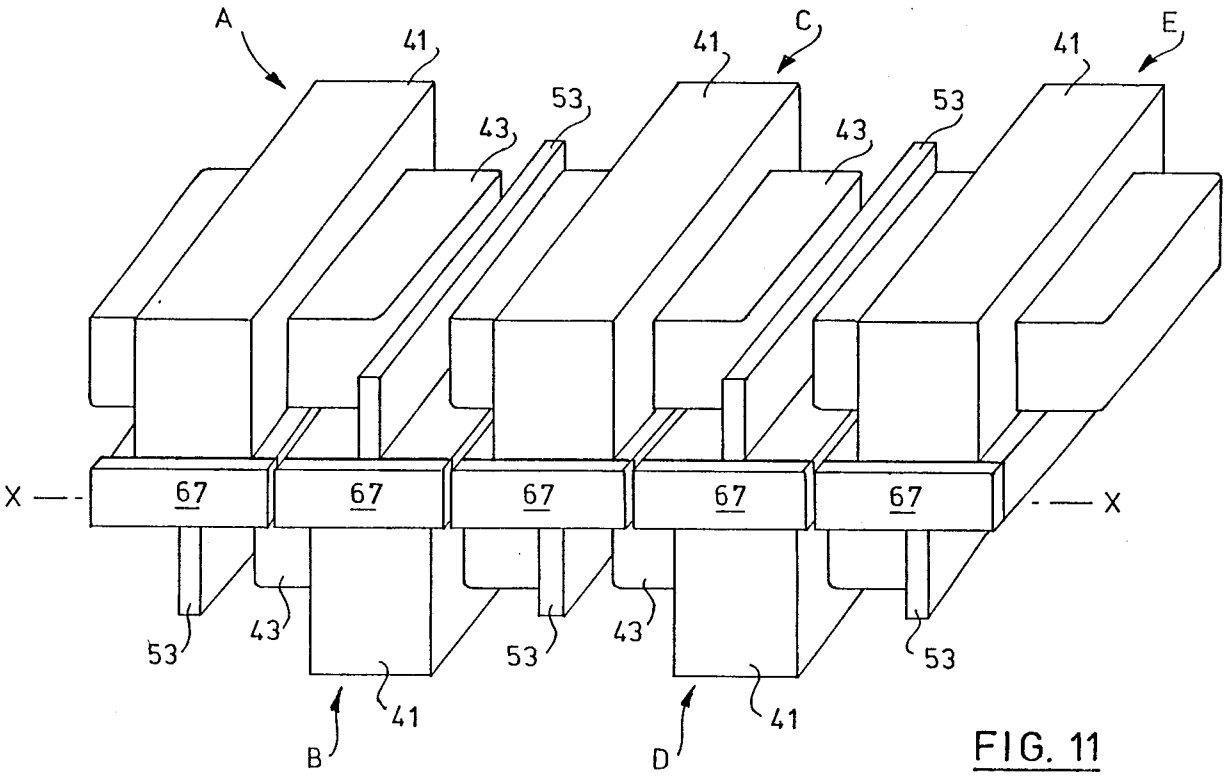
FIG. 11 is a perspective view of the bank of hammers illustrated in FIG. 10.

FIGS. 10 and 11 illustrate how five of the actuators illustrated in FIG. 9 can be assembled to form a hammer bank embodying the invention. The actuators, labelled A, B, C, D and E and cross hatched in different ways in order that the components of individual actuators can be more clearly distinguished, are assembled with the stator parts 41 and the coils 43 of adjacent actuators located on opposite sides of a central line X—X on which are located all the armature members 44 and the hammer heads 67. Each hammer head 67 is spaced apart from the adjacent hammer head by a small distance so as to allow the hammer heads to move freely relative to one another. It will be seen that the components of adjacent actuators are complementary in shape so that projecting components of each actuator engage in recessed components of the adjacent actuator. The projecting outer side surfaces of each coil 43 extend towards and are spaced a small distance from the recessed leg portions 53 of the adjacent actuators. The overall length of the hammer bank in the direction of the line X—X is therefore less than the sum of the widths of the individual actuators. The hammer bank is therefore very compact.

Each coil 43 has a relatively large volume so that there is a minimum of heat generation in each coil and good heat dissipation.

The configuration of each actuator allows the armature member 44 to be relatively short, thereby reducing the mass of the armature member. The reduced mass increases the acceleration for the same applied force. The printing impact is unaffected due to the compensating effects of the reduction of mass and the increase in velocity.

In a practical embodiment of a hammer bank as illustrated in FIGS. 10 and 11 the mass of each armature member 44 was 150 mg and the width of each hammer head was 7.62 mm (0.3 in). The average acceleration force imparted to each armature member for a travel of 0.178 mm (0.007 in) was 5 Newtons. If a maximum working gap of 0.51 mm (0.020 in) is assumed, a repetition rate for operation of each of the actuators of 2000 cycles per second would be achievable.

Figure 12:
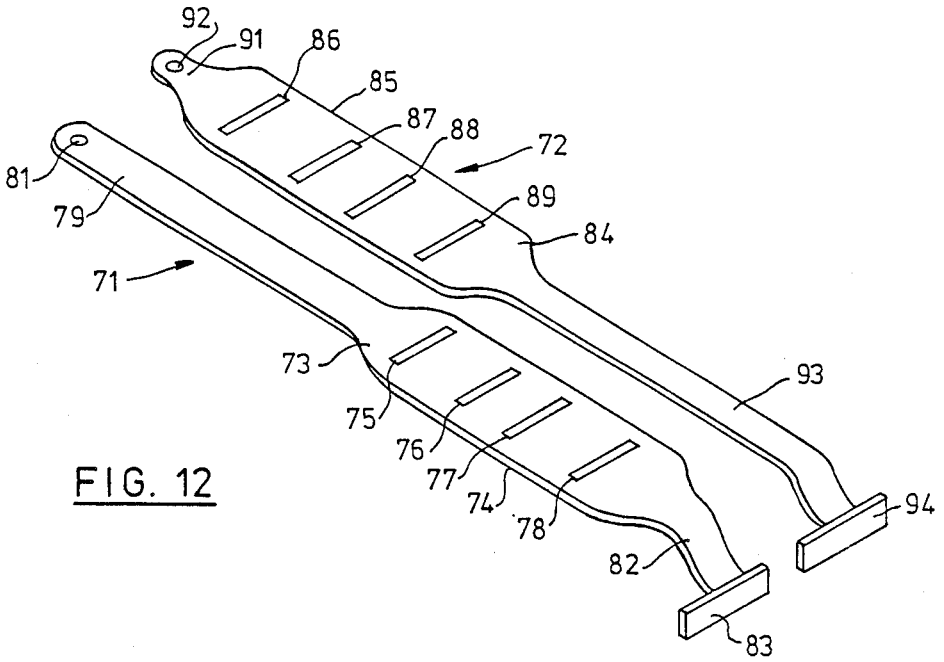
FIG. 12 is a perspective view of a pair of armature members used in another practical embodiment of the actuator illustrated in FIGS. 1, 2, 3 and 4.
Figure 13:
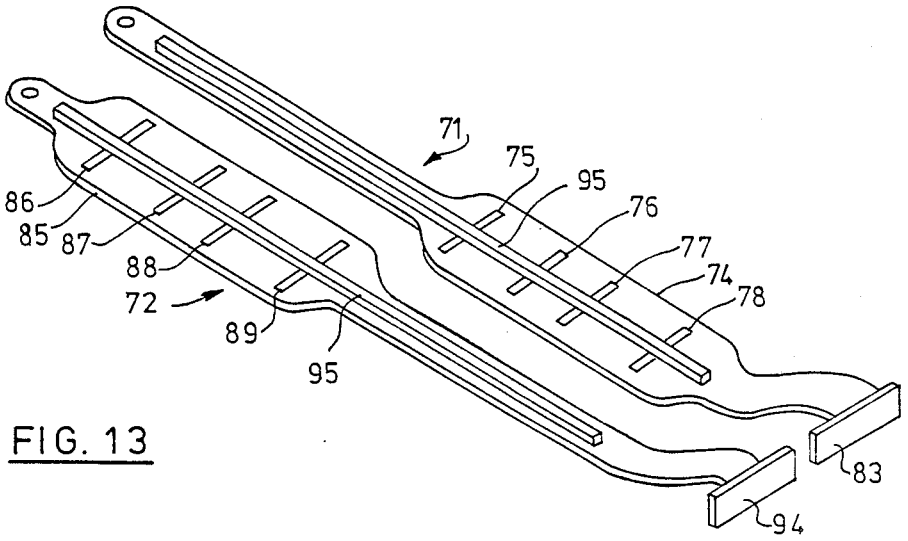
FIG. 13 is a perspective view from underneath of the pair of armature members illustrated in FIG. 12.

FIGS. 12, 13, 14, 15, 16, 17 and 18 illustrate another actuator which is a practical embodiment of the actuator illustrated in FIGS. 1, 2, 3 and 4. FIGS. 12 and 13 illustrate two forms 71, 72 of the armature member of the actuator which are adapted to be assembled close together. Armature member 71 comprises a body 73 of a non-magnetizable material having a relatively wide middle portion 74 in which are located four armature elements 75, 76, 77 and 78 of magnetizable material, a relatively narrow tail portion 79 formed with a hole 81 and a relatively narrow curved neck portion 82 to the end of which is attached a hammer head 83. The tail portion 79 is longer than the neck portion 82. The other armature member 72 also comprises a body 84 of a non-magnetizable material having a relatively wide middle portion 85 in which are located four armature elements 86, 87, 88 and 89 of magnetizable material, a relatively narrow tail portion 91 formed with a hole 92 and a relatively narrow curved neck portion 93 to the end of which is attached a hammer head 94. The tail portion 91 is shorter than the neck portion 93. As illustrated in FIG. 13 the under surface of each of the armature members 71, 72 is formed with a longitudinal rib 95 and the armature elements extend through the full thickness of each armature member. It will be seen that the two armature members 71 and 72 are complementary in shape so that, if the armature members are placed side by side, projecting components of each armature member engage in recessed components of the other armature member. This is illustrated in FIGS. 12 and 13. The relatively wide middle portion of each armature member engages in the recess formed by the relatively narrow tail portion or the relatively narrow neck portion of the other armature member so that the two armature members can be placed very close together.

Figure 14:
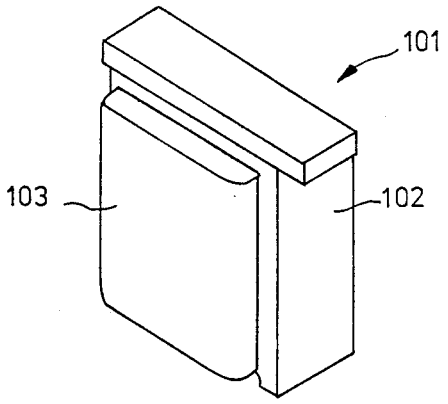
FIG. 14 is a perspective view of part of a stator which is used with one of the armature members illustrated in FIGS. 12 and 13.
Figure 15:
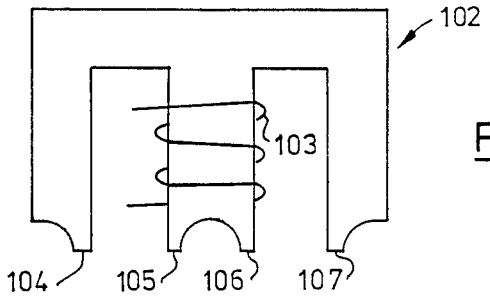
FIG. 15 is a diagrammatic side view of the stator part illustrated in FIG. 14.
Figure 16:
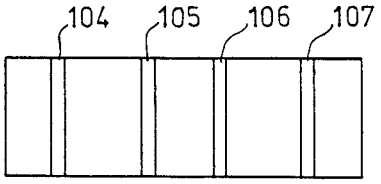
FIG. 16 is a view from underneath of the stator part illustrated in FIG. 14.

FIGS. 14, 15 and 16 illustrate a stator part 101 to be used with each of the armature members 71 and 72. Each stator part 101 comprises a yoke 102 and a coil 103. As seen most clearly in FIG. 15, the yoke 102 is shaped so as to form four pole pieces 104, 105, 106 and 107 which are spaced apart by the same distances as the armature elements 75, 76, 77 and 78 and 86, 87, 88 and 89.

Figure 17:
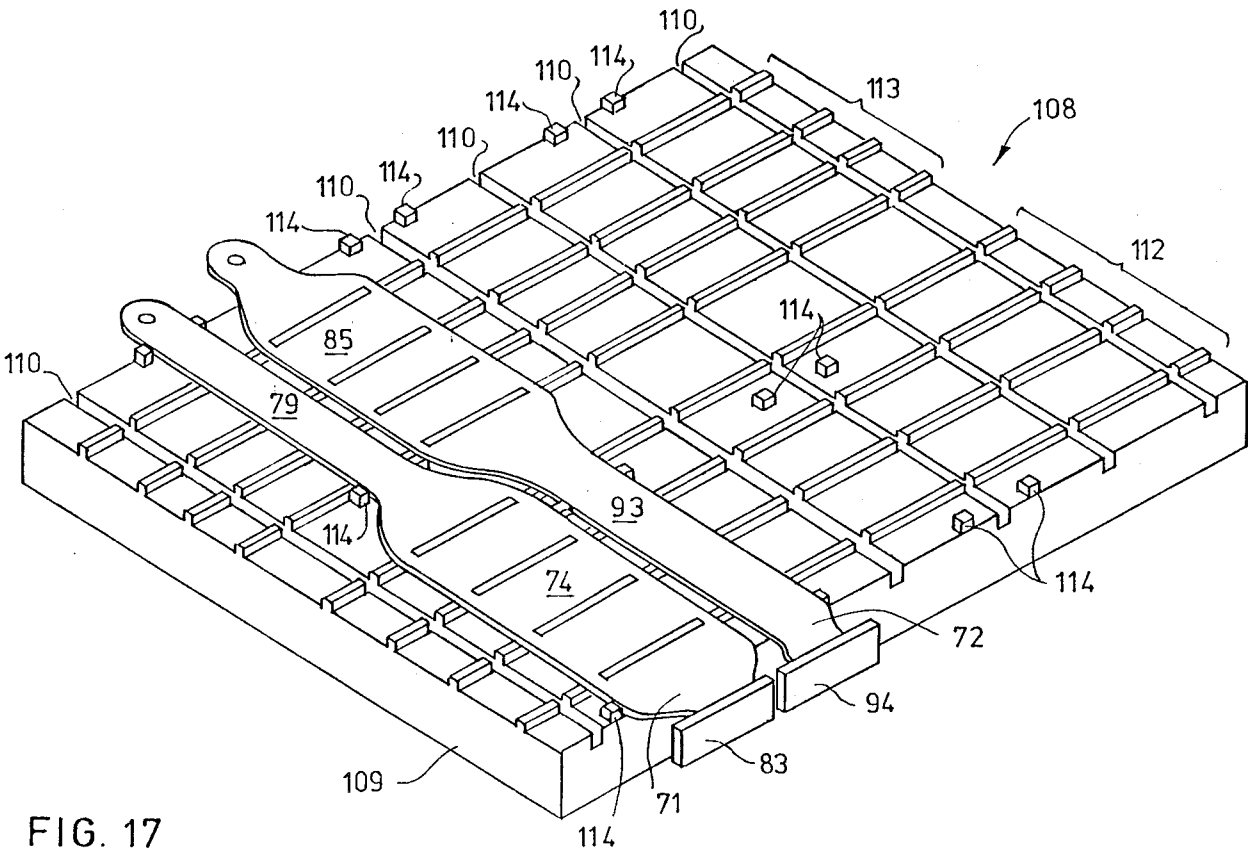
FIG. 17 is a perspective view of another stator part used with the armature members illustrated in FIGS. 12 and 13.

FIG. 17 illustrates another stator part 108 to be used with the armature members 71 and 72. Stator part 108 is a flat rectangular block 109 formed on its upper surface with a plurality of parallel grooves 110 and two sets of pole pieces or parallel ridges 112 and 113 extending at right angles to the grooves 110. The ridges 112 are spaced apart by distances equal to the spacing of the armature elements 75, 76, 77 and 78 of the armature member 71 and the ridges 113 are spaced apart by a distance equal to the spacing of the armature elements 86, 87, 88 and 89 of the armature member 72. Guide members 114 are located at various positions on the upper surface of the block 109 adjacent to the grooves 110 as indicated.

FIG. 17 illustrates one armature member 71 and one armature member 72 in position on the upper surface of the block 109. Each armature member is located in position by its longitudinal guide rib 95 engaging in one of the grooves 110 and the sides of the armature member engaging with the guide members 114. If the armature member 71 is accurately positioned so that its armature elements 75, 76, 77 and 78 coincide with the ridges 112 and the armature member 72 is accurately positioned so that its armature elements 86, 87, 88 and 89 coincide with the ridges 113 the wide middle portion 74 of armature member 71 will engage in the recess formed by the narrow neck portion 93 of armature member 72 and the wide middle portion 85 of the armature member 72 will engage in the recess formed by the narrow tail portion 79 of the armature member 71. The width of the region on the upper surface of the block 109 occupied by the armature members 71 and 72 will be less than the sum of the overall widths of two armature members.

Figure 18:
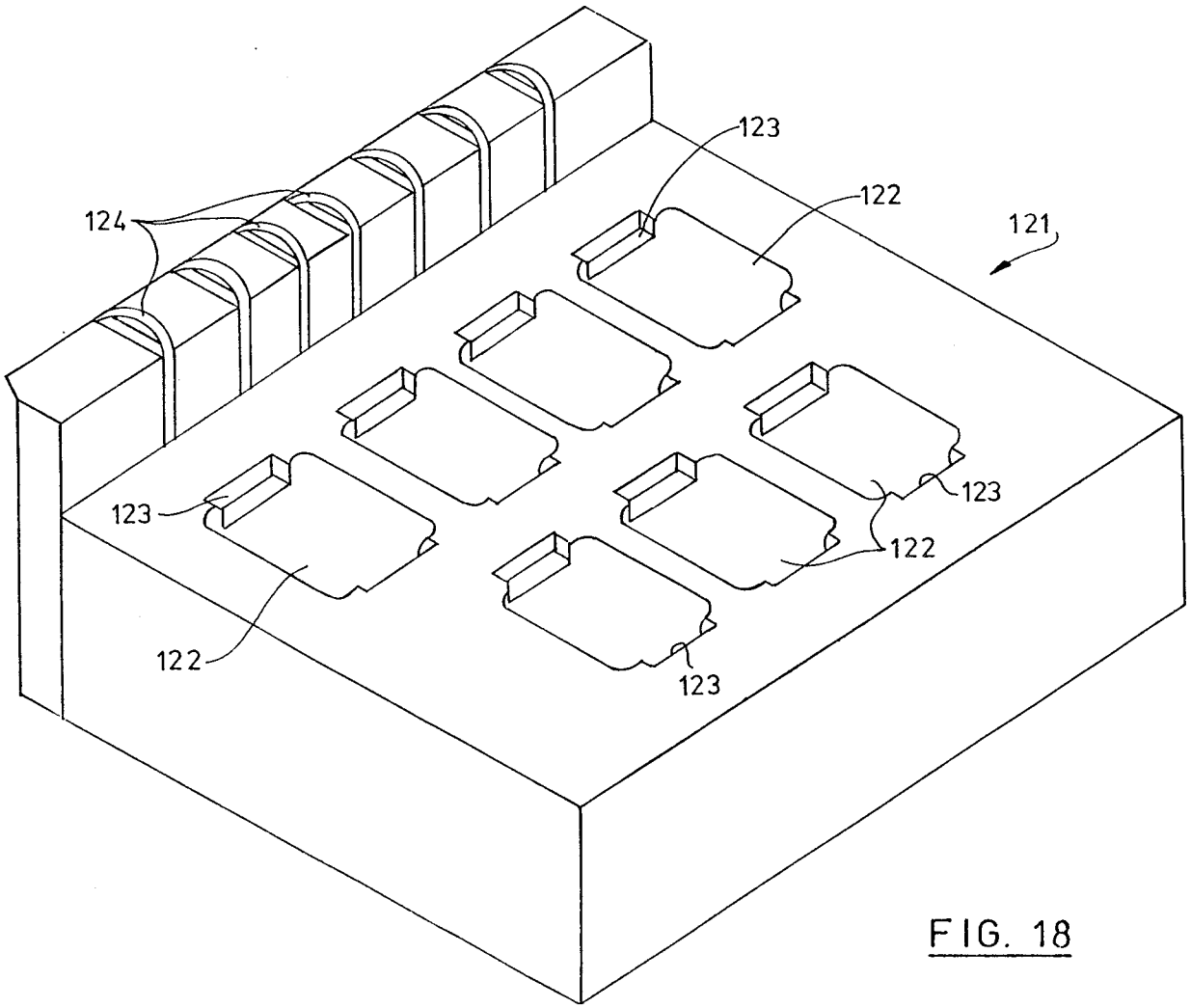
FIG. 18 is a perspective view of a block adapted to hold a plurality of the stator parts illustrated in FIGS. 14, 15 and 16.

FIG. 18 illustrates a block 121 adapted to hold a plurality of stator parts of the type illustrated in FIGS. 14, 15 and 16. The block 121 is formed with seven holes 122 arranged in two rows as illustrated, with three holes 122 in the row nearer the front of the block and four holes 122 in the row nearer the back of the block. Each hole 122 is formed with a ledge 123 at the front and the back. At the back of the block are supported seven springs 124 which extend down into the block.

Figure 19:
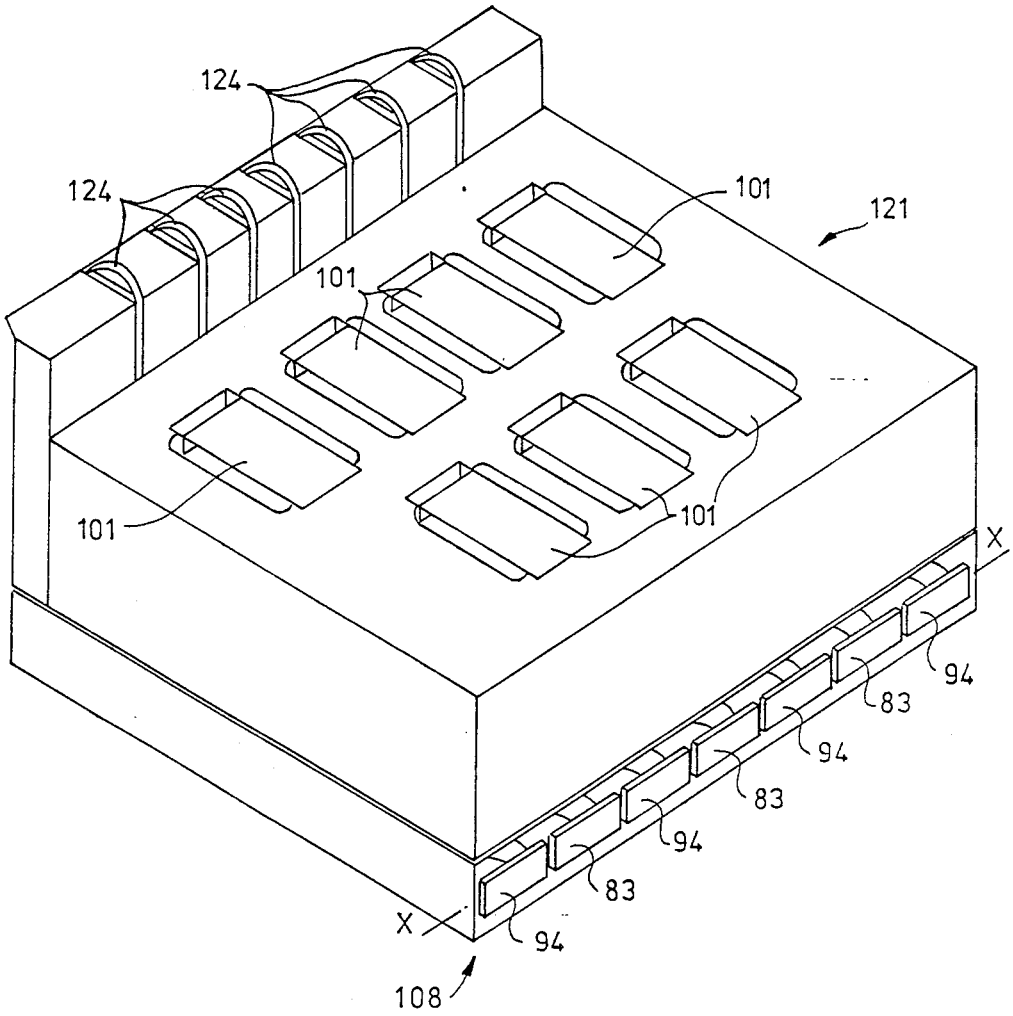
FIG. 19 is a perspective view of a plurality of actuators assembled from the components illustrated in FIGS. 12, 13, 14, 15, 16, 17 and 18 to form a bank of hammers embodying the invention.

FIG. 19 illustrates how three of the armature members 71 and four of the armature members 72, seven of the stator parts 101, one block 109 and one block 121 can be assembled to form a hammer bank embodying the invention. As illustrated, the three armature members 71 with their hammer heads 83 are positioned on the block 109 with their ribs 95 engaging in alternate grooves 110 so that the heads 83 project beyond the front edge of the block 109. In this position the wide middle portion 74 of each armature member 71 is located over the set of ridges 112. The four armature members 72 with their hammer heads 94 are positioned on the block 109 with their ribs 95 engaging in alternate grooves 110 so that the heads 94 project beyond the front edge of the block 109 and are located in between the heads 83 of the armature members 71. In this position the wide middle portion 85 of each armature member 72 is located over the set of ridges 113. The block 121 is placed over the armature members and the holes 122 in the block are positioned so that the three holes in the front row coincide with the wide middle portions 74 of the three armature members 71 and the four holes in the rear row coincide with the wide middle portions 85 of the four armature members 72.

A stator part 101 is located in each of the holes 122 and the pole pieces 104, 105, 106 and 107 of these stator parts coincide with the ridges of the sets of ridges 112 and 113 so as to form pole pairs of the type described above with reference to FIGS. 1, 2, 3 and 4. The lower ends of the springs 124 engage in the holes 81 and 92 in the narrow portions of the armature members 71, 72 remote from their hammer heads 83, 94. All the hammer heads 83 and 94 extend along a line X—X.

When the armature members 71, 72 are in the rest position, each of the armature elements 75, 76, 77 and 78 and 86, 87, 88 and 89 is spaced from a respective one of the pole pairs formed by the sets of ridges 112 and 113 and the pole pieces 104, 105, 106 and 107. If the coil 103 of any one of the stator parts 102 is energized, the armature elements of the associated armature member will be attracted into the gaps between the adjacent pole pairs and the armature member will move against the action of the associated spring 124. As a result, the associated hammer head will move into a print position.

It will be appreciated that, since the wide middle portion of each of the armature members 71, 72 engages in the narrow portions of the adjacent armature members, the length of the assembly of actuators along the line X—X is less than the sum of the overall widths of all the individual actuators. As a result the assembly forming the hammer bank is compact.

Figure 20:
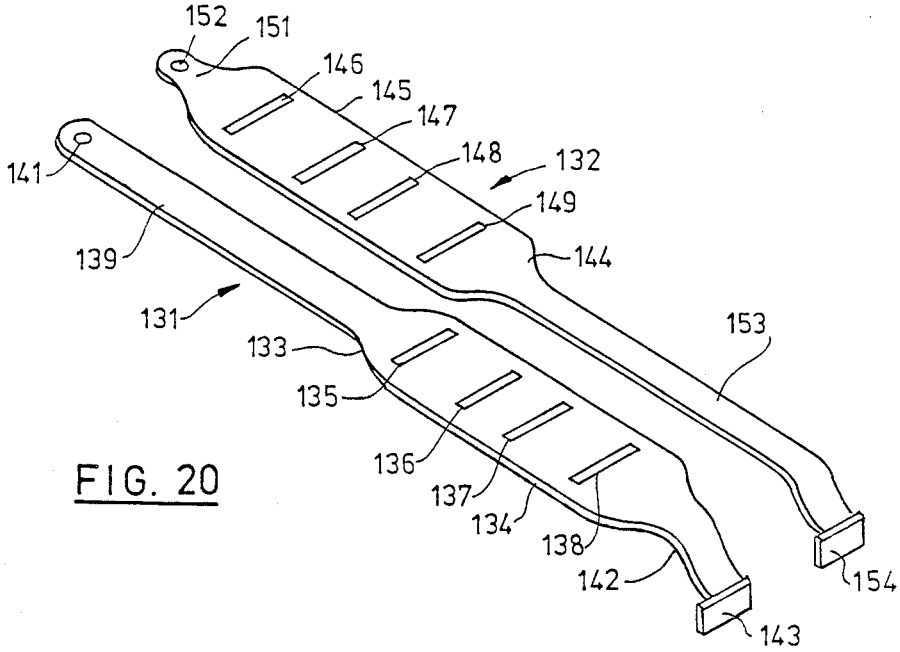
FIG. 20 is a perspective view of another pair of armature members used in a still further practical embodiment of the actuator illustrated in FIGS. 1, 2, 3 and 4.
Figure 21:
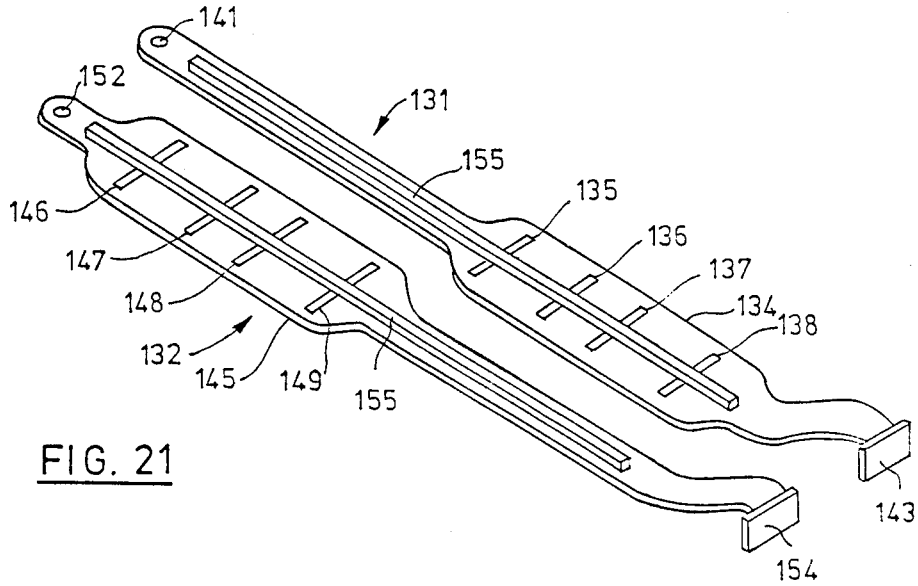
FIG. 21 is a perspective view from underneath of the pair of armature members illustrated in FIG. 20.
Figure 22:
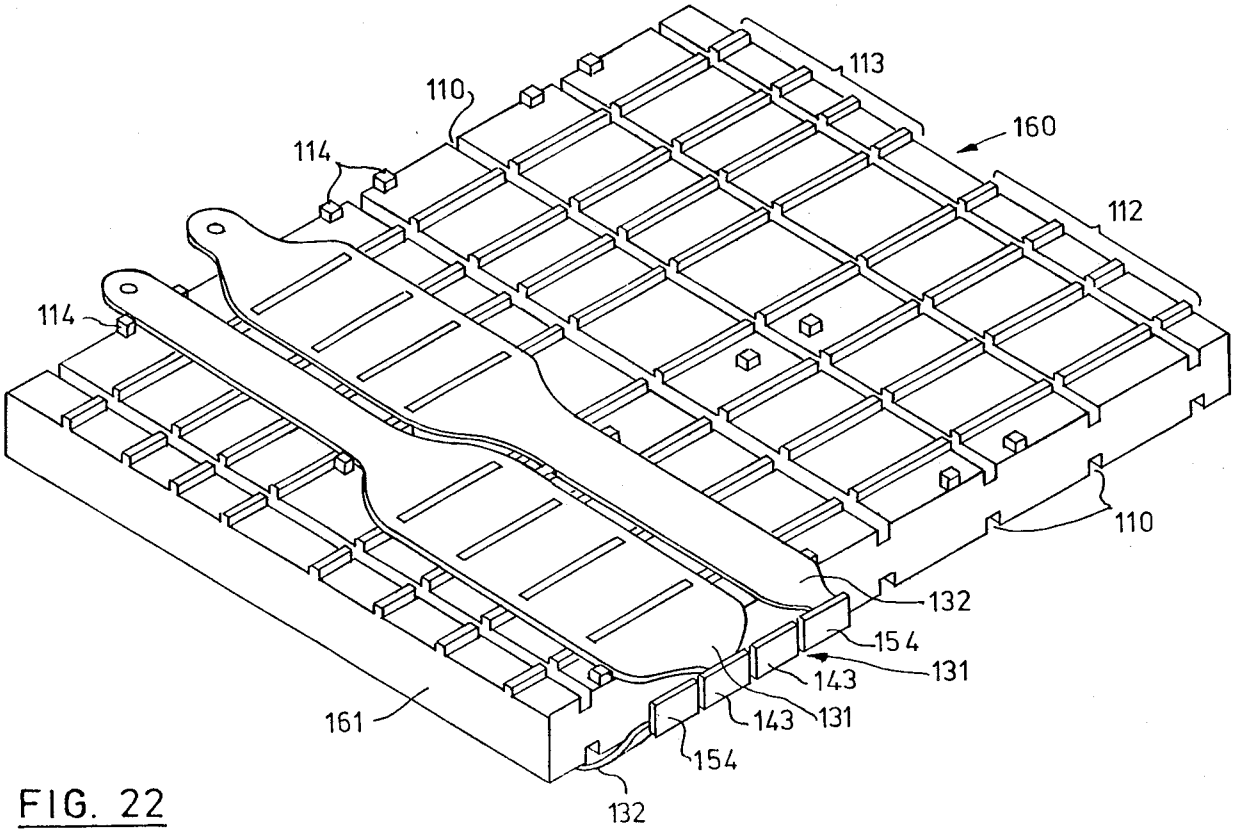
FIG. 22 is a perspective view of a stator part for use with the armature members illustrated in FIGS. 20 and 21.

FIGS. 20, 21 and 22 illustrate another actuator which is a practical embodiment of the actuator illustrated in FIGS. 1, 2, 3 and 4. FIGS. 20 and 21 illustrate two forms 131 and 132 of the armature member of the actuator which are adapted to be assembled close together. Armature member 131 comprises a body 133 of a non-magnetizable material having a relatively wide middle portion 134 in which are located four armature elements 135, 136, 137 and 138 of magnetizable material, a relatively narrow tail portion 139 formed with a hole 141 and a relatively narrow curved neck portion 142 to the end of which is attached a hammer head 143. The tail portion 139 is longer than the neck portion 142. The other armature member 132 also comprises a body 144 of a non-magnetizable material having a relatively wide middle portion 145 in which are located four armature elements 146, 147, 148 and 149 of magnetizable material, a relatively narrow tail portion 151 formed with a hole 152 and a relatively narrow curved neck portion 153 to the end of which is attached a hammer head 154. The tail portion 151 is shorter than the neck portion 153. As illustrated in FIG. 21 the under surface of each of the armature members 131, 132 is formed with a longitudinal rib 155 and the armature elements extend through the full thickness of each armature member. It will be seen that the two armature members 131 and 132 are complementary in shape so that, if the armature members are placed side by side, projecting components of each armature member engage in recessed components of the other armature member. This is illustrated in FIGS. 20 and 21. The relatively wide middle portion of each armature member engages in the recess formed by the relatively narrow tail portion or the relatively narrow neck portion of the other armature member so that the two armature members can be placed very close together.

FIG. 22 illustrates a stator part 160 to be used with the armature members 131 and 132. Stator part 160 is similar to the stator part 108 illustrated in FIG. 17 and is a flat rectangular block 161 formed on its upper and lower surfaces with a plurality of parallel grooves 110 and two sets of parallel ridges 112 and 113 extending at right angles to the grooves 110. The ridges 112 are spaced apart by distances equal to the spacing of the armature elements 135, 136, 137 and 138 of the armature member 131 and the ridges 113 are spaced apart by distances equal to the spacing of the armature elements 146, 147, 148 and 149 of the armature member 132. Guide members 114 are located at various positions on the upper and lower surfaces of the block 109 adjacent to the grooves 110 as indicated.

FIG. 22 illustrates one armature member 131 and one armature member 132 in position on the upper surface of the block 161 and one armature member 131 and one armature member 132 in position on the lower surface of the block 161. Each armature member is located in position by its longitudinal guide rib 155 engaging in one of the grooves 110 and the sides of the armature member engaging with the guide members 114. If each armature member 131 is accurately positioned so that its armature elements 135, 136, 137 and 138 coincide with the ridges 112 and each armature member 132 is accurately positioned so that its armature elements 146, 147, 148 and 149 coincide with the ridges 113, the wide middle portion 134 of each armature member 131 will engage in the recess formed by the narrow neck portion 153 of the adjacent armature member 132. The widths of the regions on the upper and lower surfaces of the block 161 occupied by the armature members 131 and 132 will be less in each case than the sum of the overall widths of the armature members on the surfaces.

Figure 23:
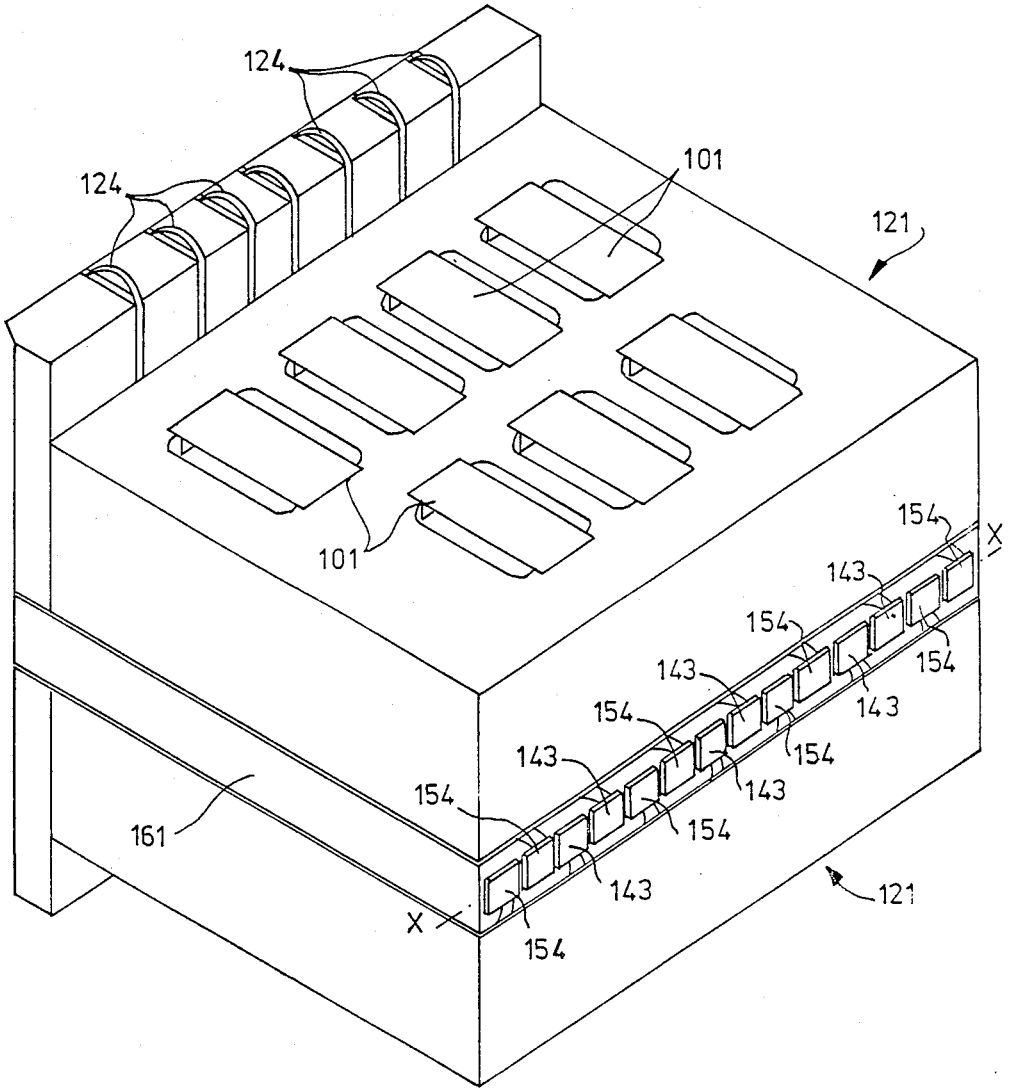
FIG. 23 is a perspective view of a plurality of actuators assembled from the components illustrated in FIGS. 20, 21 and 22 to form a bank of hammers embodying the invention.

FIG. 23 illustrates how six of the armature members 131 and eight of the armature members 132, fourteen of the stator parts 101, one block 161 and two blocks 121 can be assembled to form a hammer bank embodying the invention. As illustrated, three armature members 131 with their hammer heads 143 are positioned on the upper surface of block 161 with their ribs 155 engaging in alternate grooves 110 (FIG. 22) so that the heads 143 project beyond the front edge of the block 161 and three armature members 131 with their hammer heads 143 are positioned on the lower surface of block 161 with their ribs 155 engaging in alternate grooves 110 (FIG. 22) so that the heads 143 project beyond the front edge of the block 161. In this position the wide middle portion 134 of each armature member 131 is located over the set of ridges 112 (FIG. 22). Four armature members 132 with their hammer heads 154 are positioned on the upper surface of block 161 with their ribs 155 engaging in alternate grooves 110 (FIG. 22) so that the heads 154 project beyond the front edge of the block 161 and are located in between the heads 143 of the armature members 131 and four armature members 132 with their hammer heads 154 are positioned on the lower surface of block 161 with their ribs 155 engaging in alternate grooves 110 (FIG. 22) so that the heads 154 project beyond the front edge of the block 161 and are located in between the heads 143 of the armature members 131. In this position the wide middle portions 145 of each armature member 132 is located over the set of ridges 113 (FIG. 22). One block 121 is placed over the armature members on the upper surface of the block 161 and the holes 122 in the block 121 (FIG. 18) are positioned so that the three holes in the front row coincide with the wide middle portions of the three armature members 131 and the four holes in the rear row coincide with the wide middle portions of the four armature members 132. Another block 121 is placed over the armature members on the lower surface of the block 161 and the holes 122 in the block are positioned so that the three holes in the front row coincide with the wide middle portions of the three armature members 131 and the four holes in the rear row coincide with the wide middle portions of the four armature members 132.

A stator part 101 is located in each of the holes 122 and the pole pieces 104, 105, 106 and 107 of these stator parts coincide with the ridges of the sets of ridges 112 and 113 so as to form pole pairs of the type described above with reference to FIGS. 1, 2, 3 and 4. The lower ends of the springs 124 engage in the holes 141 and 152 in the narrow portions of the armature members 131, 132 remote from their hammer heads 143, 154. All the hammer heads 143 and 154 extend along a line X—X.

When the armature members 131, 132 are in the rest position, each of the armature elements 135, 136, 137 and 138 and 146, 147, 148 and 149 is spaced from a respective one of the pole pairs formed by the sets of ridges 112 and 113 and the pole pieces 104, 105, 106 and 107. If the coil 103 of any one of the stator parts 102 is energized, the armature elements of the associated armature member will be attracted into the gaps between the adjacent pole pairs and the armature member will move against the action of the associated spring 124. As a result, the associated hammer head will move into a print position.

It will be appreciated that, since the wide middle portion of each of the armature members 131, 132 engages in the narrow portions of the adjacent armature members, the length of the assembly of actuators along the line X—X is less than the sum of the overall widths all the individual actuators. As a result the assembly forming the hammer bank is compact.

What we claim is:

1. An assembly of electromagnetic actuators forming a hammer bank of an impact printer, said actuators arranged side by side and extending along a line, in which each actuator comprises:

a first stator part formed with at least one pole piece, a second stator part having a substantially planer central portion formed with at least one pole piece thereon and positioned relative to said first stator part so that said pole pieces are spaced apart so as to form a gap therebetween, a single coil associated with said actuator, mounted on said first stator part, said coil being substantially wider than said second stator part, all of said first stator parts and said second stator parts in said side by side arrangement lying alongside said line, said coil of one actuator engaging said second stator part of an adjacent actuator in said side by side arrangement so that the overall length of the assembly along said line is less than the sum of the widths of the coils in the assembly, an armature member formed with a body of non-magnetizable material, at least one armature element of magnetizable material and a hammer head, and means for supporting said armature member between said stator parts so that said armature element is located adjacent to said gap, whereby energization of said coil causes the generation of a flux which passes across said gap and through said armature element tending to move said armature element into said gap and to cause said hammer head to move into a print position.

2. An assembly as claimed in claim 1 wherein said second stator part has a substantially Y-shaped cross section with a lower leg and a pair of side portions constructed of non-magnetizable material.

3. An assembly as claimed in claim 1 wherein the body of each armature member has a rib extending longitudinally along said body.

4. An assembly as claimed in claim 3 wherein one of said stator parts comprises a plurality of grooves, each of said grooves adapted to receive said rib on said armature member.

5. An assembly as claimed in claim 1 wherein the body of each armature member is coated with a layer of low friction material.

6. An assembly as claimed in claim 1 wherein each armature element extends across the width of the associated armature member and is rectangular in cross section.

* * * * *